US011719260B2

(12) United States Patent
Ifrim

(10) Patent No.: US 11,719,260 B2
(45) Date of Patent: Aug. 8, 2023

(54) MULTI-FLUID MANAGEMENT WITH INSIDE OUT FLUID SYSTEMS

(71) Applicant: FMC Technologies, Inc., Houston, TX (US)

(72) Inventor: Costin Ifrim, Fullerton, CA (US)

(73) Assignee: FMC Technologies, Inc., Houston, TX (US)

( * ) Notice: Subject to any disclaimer, the term of this patent is extended or adjusted under 35 U.S.C. 154(b) by 476 days.

(21) Appl. No.: 16/759,234

(22) PCT Filed: Oct. 26, 2018

(86) PCT No.: PCT/US2018/057742

§ 371 (c)(1),
(2) Date: Apr. 24, 2020

(87) PCT Pub. No.: WO2019/084424

PCT Pub. Date: May 2, 2019

(65) Prior Publication Data

US 2020/0340498 A1 Oct. 29, 2020

Related U.S. Application Data

(60) Provisional application No. 62/578,137, filed on Oct. 27, 2017.

(51) Int. Cl.
*E21B 41/00* (2006.01)
*E21B 43/36* (2006.01)
(Continued)

(52) U.S. Cl.
CPC ..... *F04D 31/00* (2013.01); *E21B 41/0007* (2013.01); *E21B 43/36* (2013.01);
(Continued)

(58) Field of Classification Search
CPC ..... E21B 41/0007; E21B 43/26; F04D 29/061
See application file for complete search history.

(56) References Cited

U.S. PATENT DOCUMENTS 6,703,741 B1 3/2004 Ifrim
8,393,876 B2 * 3/2013 Sloteman ..... F04D 9/003 417/313

(Continued)

FOREIGN PATENT DOCUMENTS

WO 2001022560 3/2001
WO 2011008103 1/2011

(Continued)

OTHER PUBLICATIONS

PCT International Search Report and Written Opinion in International Application No. PCT/US2018/057,742, dated Feb. 5, 2019, 11 pages.

*Primary Examiner* — Matthew R Buck
(74) *Attorney, Agent, or Firm* — Fish & Richardson P.C.

(57) ABSTRACT

A top side-less pump system for managing multiphase fluid includes a pump subsystem having a suction and a discharge. A first gas liquid extraction unit has a multiphase fluid inlet and a liquid outlet. The liquid outlet is coupled to the suction for providing a liquid rich fluid to the bearing lubrications. An ejector is coupled to a gas outlet of the main gas liquid extraction unit to receive a gas rich fluid. A second gas liquid extraction unit is coupled to an outlet of the ejector. A water based lubrication liquid unit is coupled to the inlets of the pump and, after being energized at higher pressure, injected into the bearings through built in lubrication and cooling passages.

19 Claims, 9 Drawing Sheets

(51) Int. Cl.

| | |
|---|---|
| ***F04D 29/06*** | (2006.01) |
| ***F04D 31/00*** | (2006.01) |
| ***F04D 13/08*** | (2006.01) |
| *F04D 3/02* | (2006.01) |

(52) U.S. Cl.
CPC ..... *F04D 13/086* (2013.01); *F04D 29/061* (2013.01); *F04D 3/02* (2013.01)

(56) References Cited

U.S. PATENT DOCUMENTS

| | | | | |
|---|---|---|---|---|
| 8,425,667 | B2 * | 4/2013 | Anderson | B01D 21/0045 96/216 |
| 8,487,493 | B2 | 7/2013 | Cunningham et al. | |
| 8,573,306 | B2 | 11/2013 | Donald et al. | |
| 8,777,596 | B2 | 7/2014 | Cunningham et al. | |
| 9,954,414 | B2 | 4/2018 | Cunningham et al. | |
| 10,263,547 | B2 | 4/2019 | Ifrim | |
| 10,393,115 | B2 | 8/2019 | Cunningham et al. | |
| 2010/0278672 | A1 * | 11/2010 | Kothnur | F04C 13/004 418/1 |
| 2015/0308444 | A1 * | 10/2015 | Trottmann | F04D 9/003 415/169.1 |
| 2015/0345265 | A1 * | 12/2015 | Cunningham | F04D 29/086 415/104 |
| 2016/0169231 | A1 | 6/2016 | Michelassi et al. | |
| 2019/0032667 | A1 | 1/2019 | Ifrim et al. | |

FOREIGN PATENT DOCUMENTS

| | | |
|---|---|---|
| WO | 2012164382 | 12/2012 |
| WO | 2015114136 | 8/2015 |
| WO | 2017021553 | 2/2017 |

* cited by examiner

MULTI-FLUID MANAGEMENT WITH INSIDE OUT FLUID SYSTEMS

CLAIM OF PRIORITY

This application is a U.S. National Phase Application under 35 U.S.C. § 371 and claims the benefit of priority to International Application Serial No. PCT/US2018/057742, filed Oct. 26, 2018, which claims priority to U.S. Provisional Patent Application No. 62/578,137 filed on Oct. 27, 2017, the entire contents of which are hereby incorporated by reference.

BACKGROUND

The concepts herein relate to managing multiphase process fluid in fluid system, e.g., a pump and/or compressor system.

Fluid systems, such as pumps and compressors, used to move fluid in and around subsea wells present multiple design challenges. The need for compactness of the fluid systems drives unique configurations such as integrated motor fluid systems. Beyond configuring the fluid moving components and the motor into a compact arrangement, difficulties arise when pumping multiphase fluid, because the fluid can vary between all gas and all liquid and mixtures in between. Thus, the fluid is typically treated to generate a liquid rich fluid for pumping.

DESCRIPTION OF DRAWINGS

Like reference symbols in the various drawings indicate like elements.

DETAILED DESCRIPTION

Figure 1A:
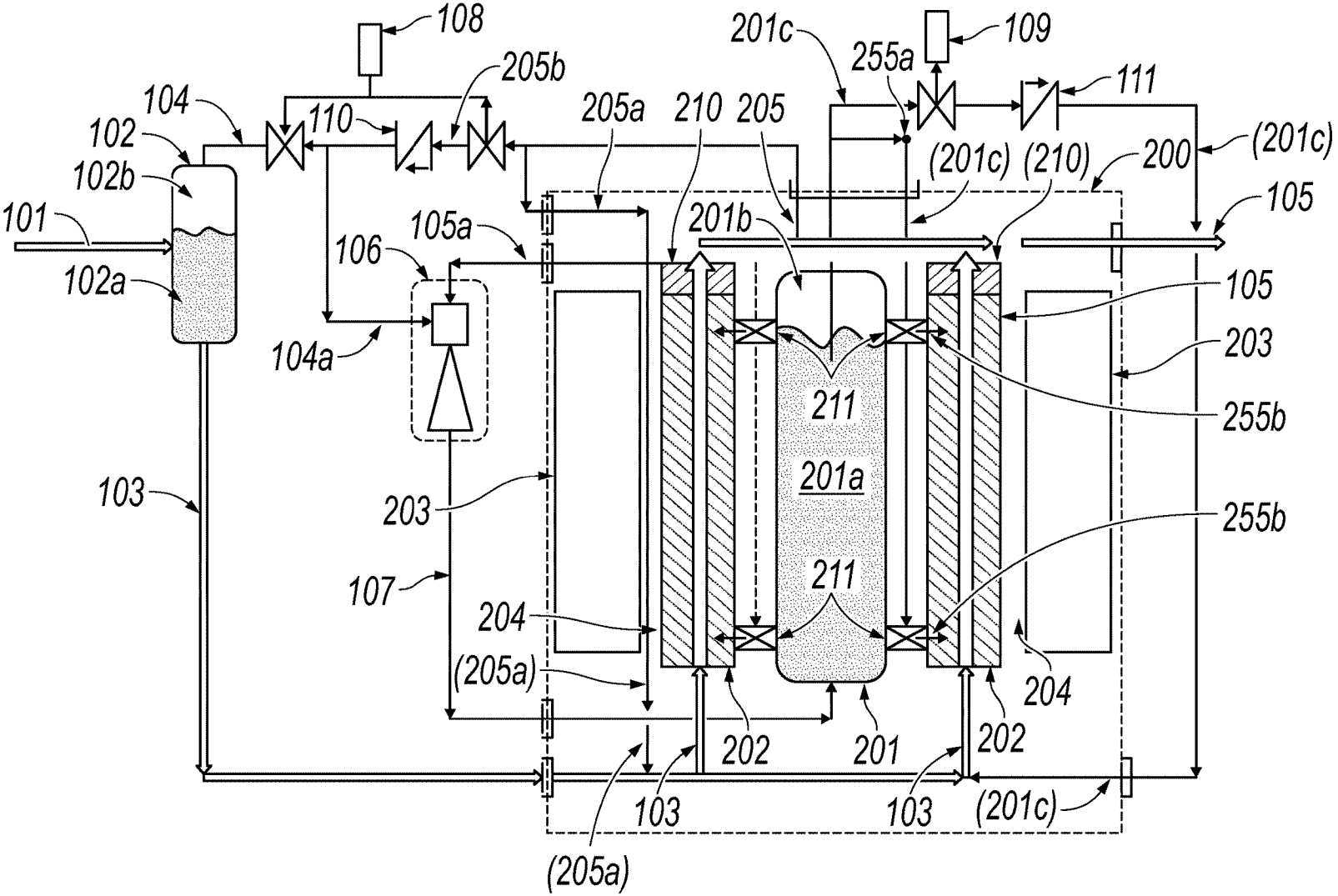
FIGS. 1A, 1B, 1C and 1D are schematic flow diagrams of four different example multiphase fluid systems.

The concepts herein relate to managing multiphase process fluid in a fluid system. In certain instances, the source of the multiphase process fluid is a natural resource, such as oil and gas, produced from a well, but the concepts herein can be applied to other sources of multiphase fluids. Moreover, the fluid system can be a subsea fluid system, configured to sit on the sea floor at a subsea well site or submerged in another body of water (e.g., lake or other). In other instances, the fluid system could be surface based (i.e., configured to reside on land or on a platform or other vessel).

Referring to FIGS. 1A-1D, an example multiphase fluid system is shown. The fluid system has a multiphase process fluid subsystem for managing flow of multiphase process fluid from the source to a pump subsystem. The multiphase process fluid inlet is 101, which, in certain instances, receives multiphase process fluid from a well or from the discharge of an upstream slug-catcher (neither shown). A slug-catcher is any number of configurations of separators in a pipeline, carrying multiphase flow, for receiving and separating out slugs of fluid in the flow.

The pump subsystem 200 is a multi-stage pump and includes a multiple pump stages 202 within a motor stator 203. There is a gap 204 between the motor stator 203 and the pump stages 202. In certain instances, the pump subsystem can be referred to as an inside-out pump, because (as described in more detail below) the electromagnetic rotor resides around the fluid impeller. The fluid system can also be characterized top side-less, meaning that the entire system (pump subsystem and its auxiliary fluid systems) are capable of operating subsea without components, such as the fluid separators, bearing lubrication systems, and the like, residing at or above the water's surface. Other configurations of pump 200, though, can used.

Figure 2A:
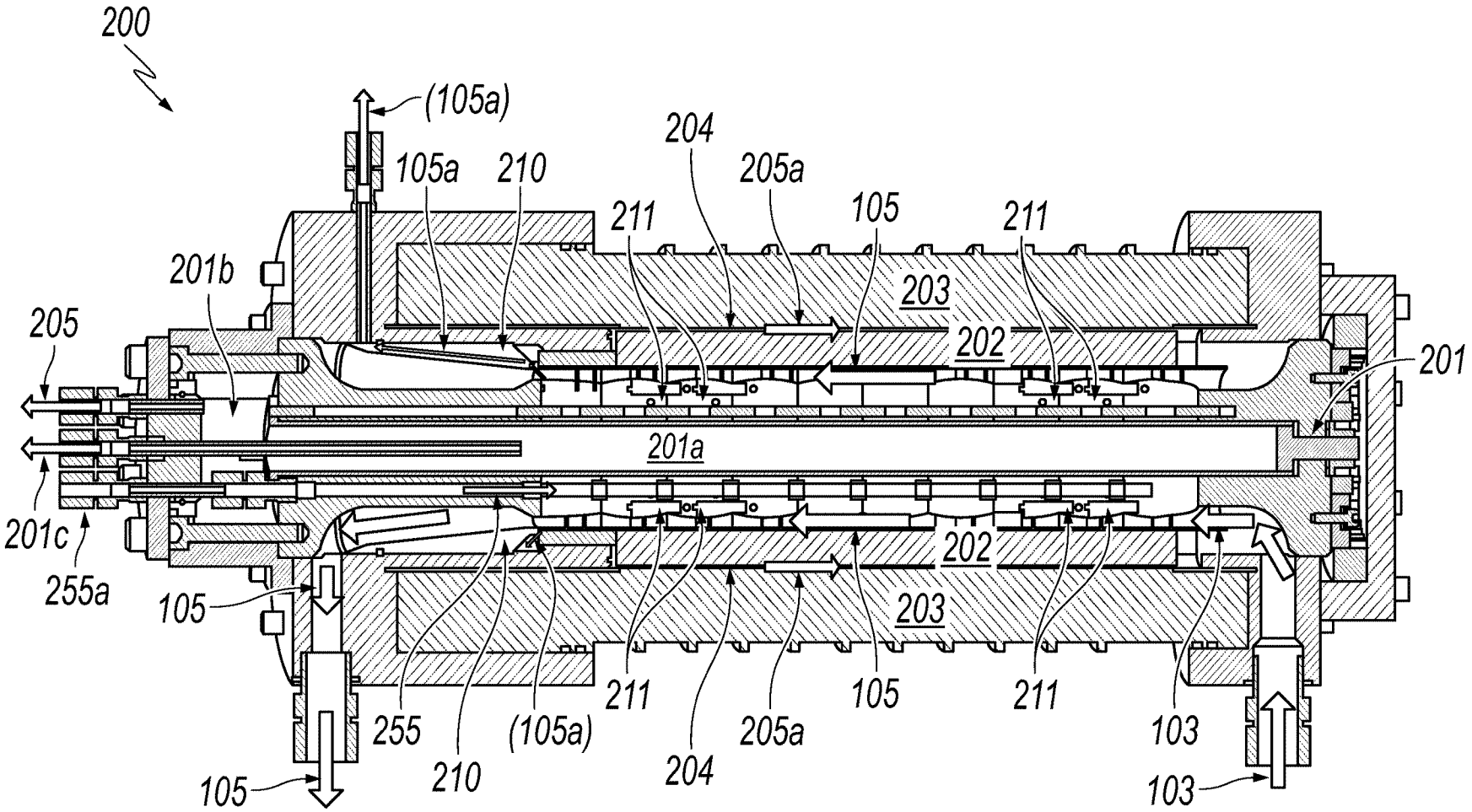
FIGS. 2A and 2B are schematic half cross-sectional views of an inside-out pump as an example of a multiphase fluid system; where the cross-section of FIG. 2A is taken at a different plane than the cross-section of FIG. 2B.
Figure 2B:
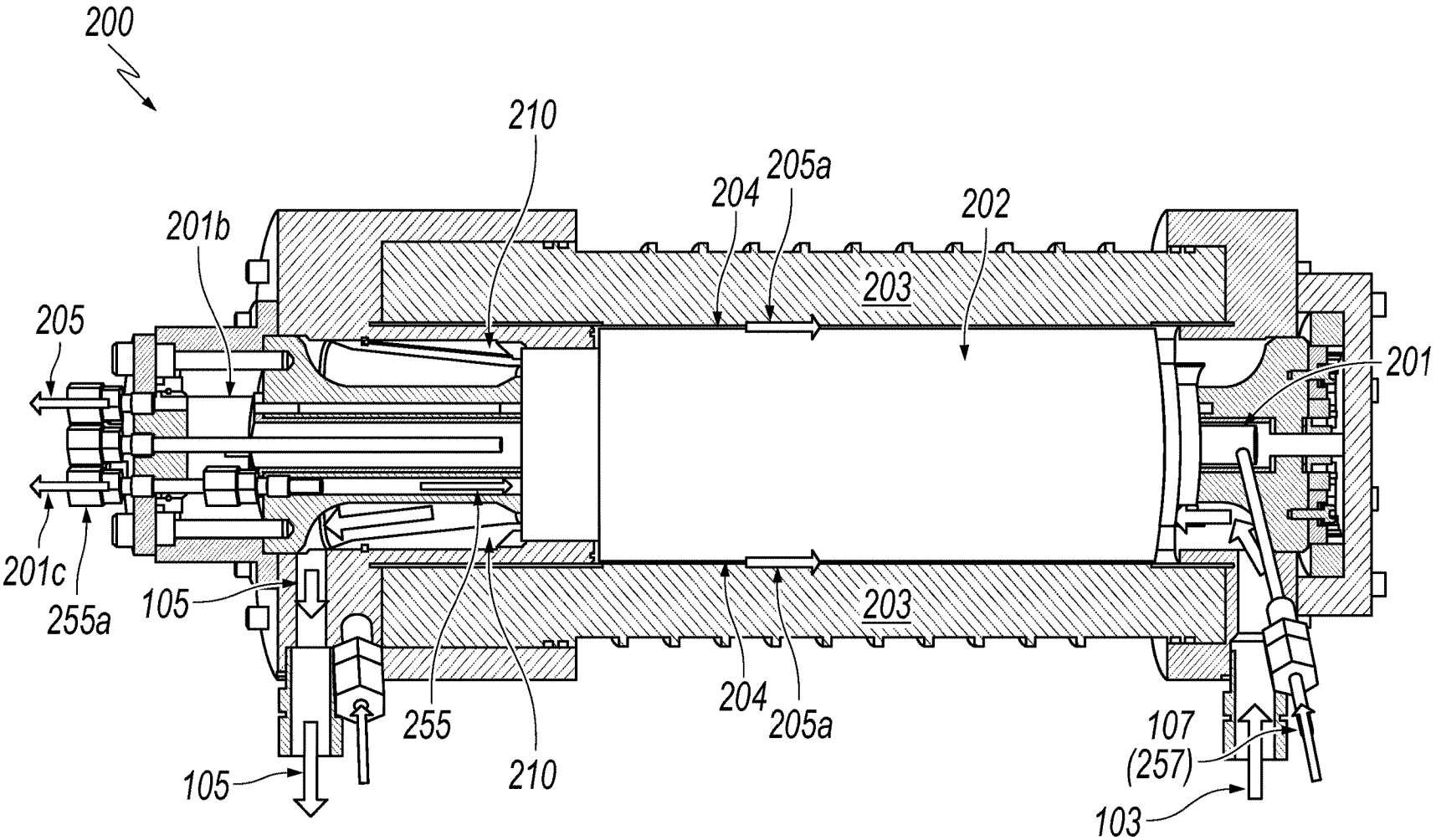
Figure 3A:
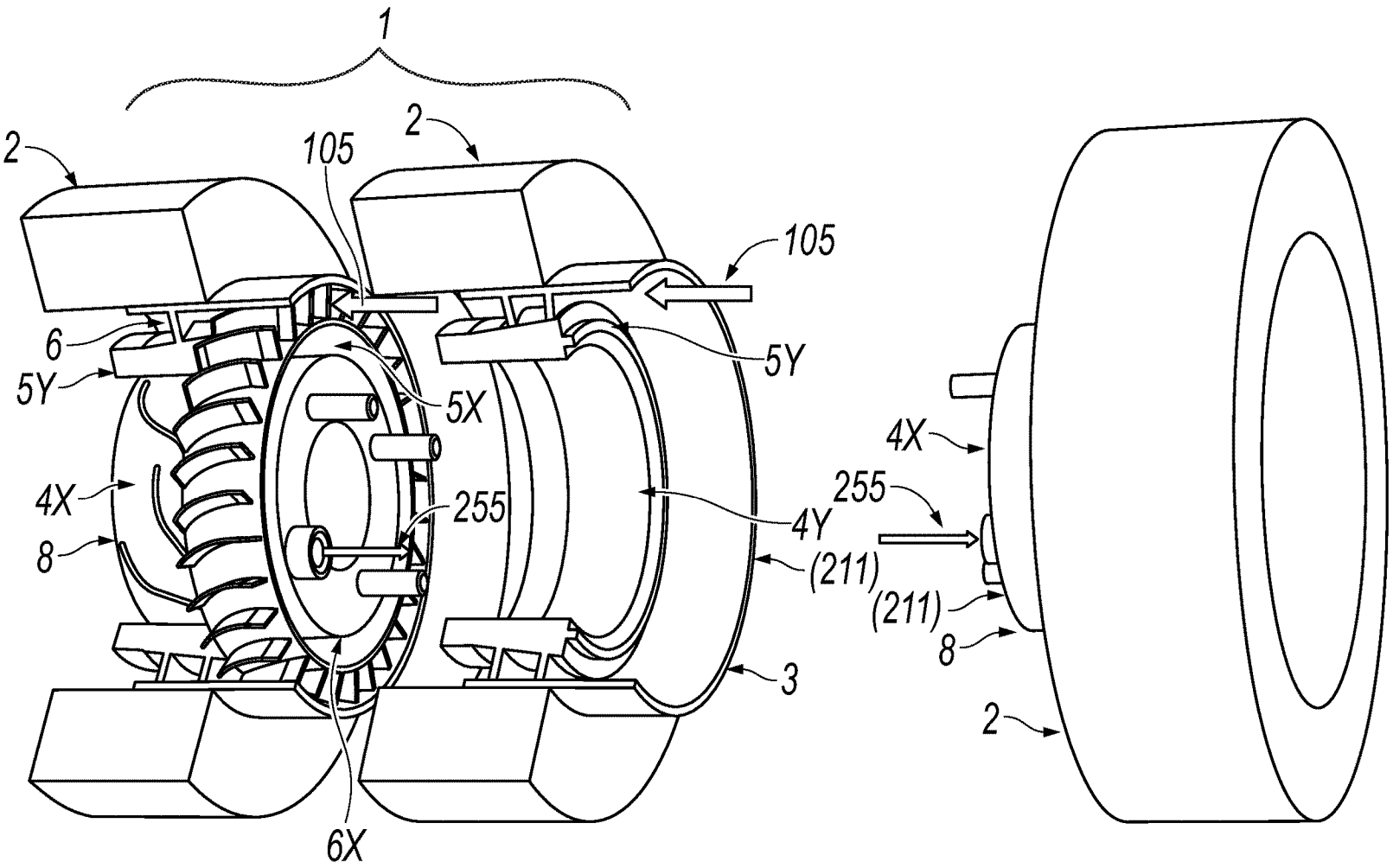
FIGS. 3A and 3B are detailed, perspective exploded views of an example helico-axial motor rotor stage pump module, showing an example of three permanent magnet based rotor sub-modules and two hydraulic stages with its rotating journal housing in two thirds cross-sectional cut away views, with two embedded journal bearing, with one axial thrust compensator and the passages for lubricating the journal bearings and fluid management for the axial thrust compensators.
Figure 3B:
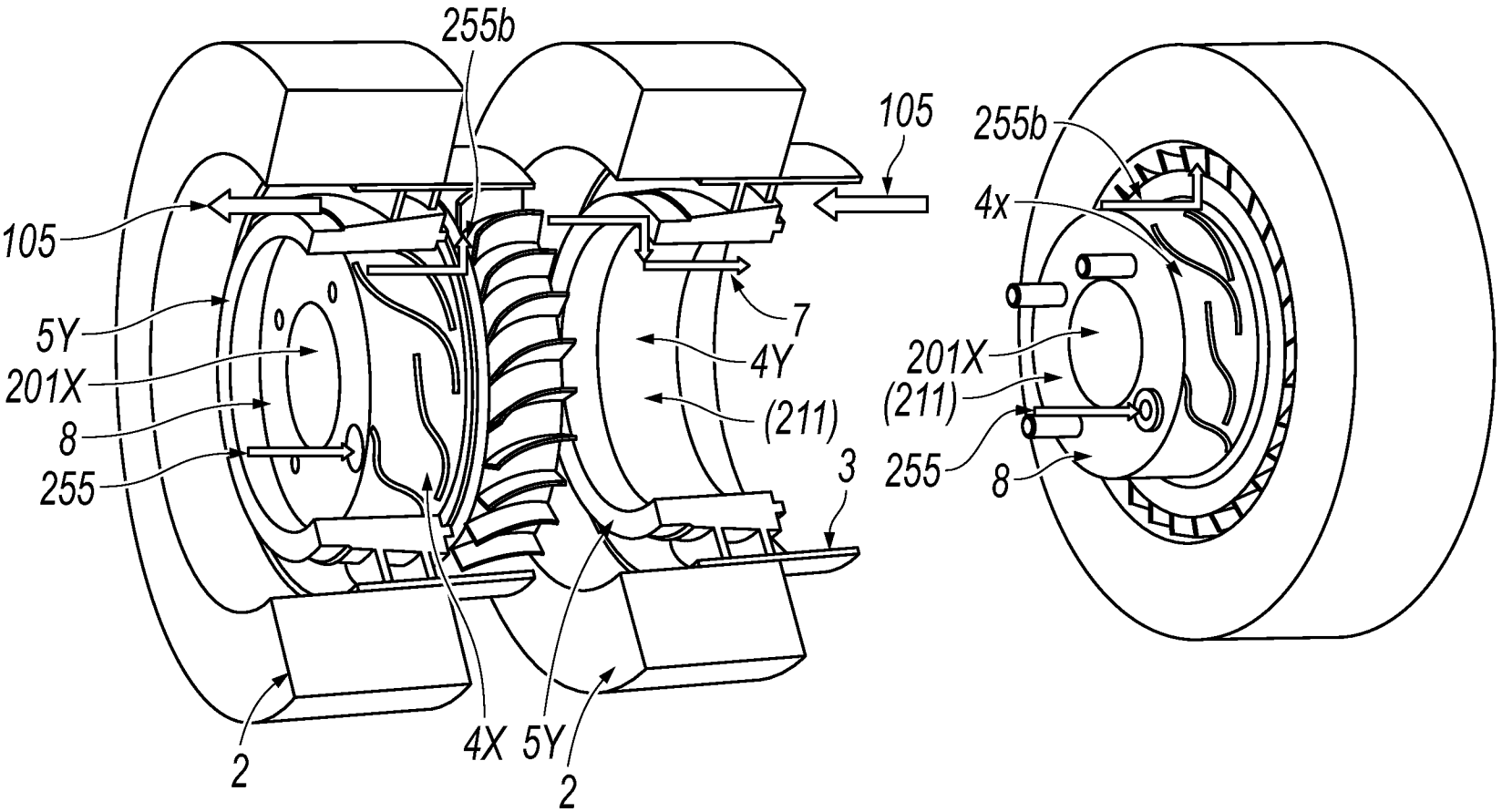
Figure 4:
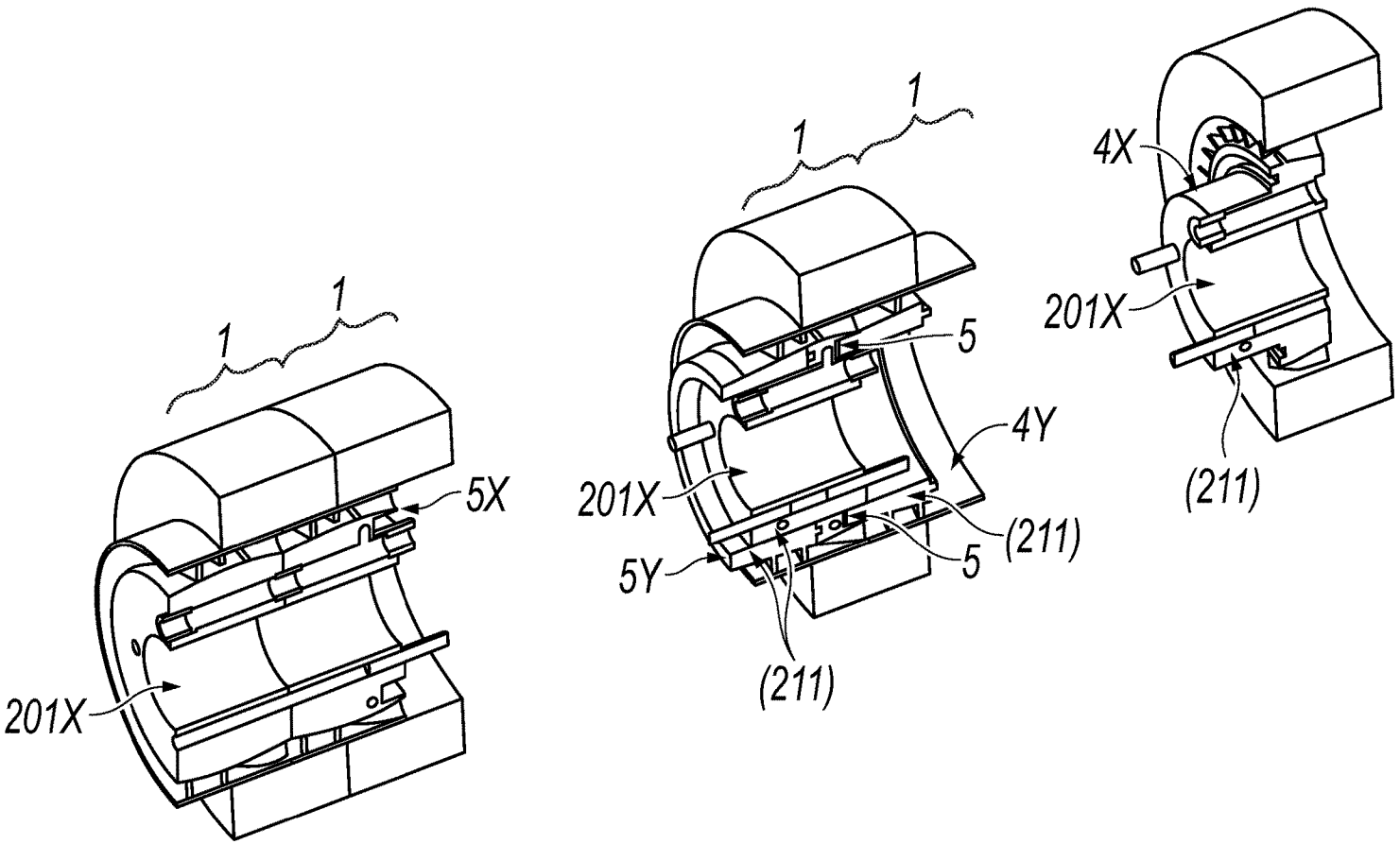
FIG. 4 is a detailed, perspective exploded view of four of the example helico-axial motor rotor and pump stages modules, again showing the permanent magnet rotor sub-modules and rotating journal housings in half cross-section cut away view, two of the modules with embedded distributed journal bearings, axial thrust compensators and lubrication passages for both the journal bearings and fluid management for the axial thrust compensators.

FIGS. 2A and 2B show a half cross-sectional schematic of an example integrated modular inside-out pump that can be used as pump 200. FIGS. 3A and 3B show detailed perspective view of a helico-axial modular motor rotor and stage pump module 1 that can be used in constructing the example inside-out pump of FIGS. 2A and 2B. FIG. 4 shows four motor rotor stage pump modules 1, two of which include radial bearing provisions and axial thrust compensators. In this example, the stage module 1 is attached inside a permanent magnet rotor module 2 and attached to a rotating journal housing 3 about a longitudinally extending stationary diffuser 8. The diffuser 8 has the provision to be concentrically attached along the surface 201X to a tubular body 201, FIGS. 2A, 3B and 4. The stage module 1 also includes a helico-axial impeller 6 interfacing with the stationary diffuser 8. In some instances, the stationary diffuser 8 is separated from the rotatable helico-axial impeller 6 by a journal bearing radial gap 4, FIG. 4, which is defined by the surfaces 4X and 4Y, FIGS. 3A and 3B. The gap 4 is filled with the medium pressure liquid rich fluid 255 directed into the gap by a set of passages that penetrate the surfaces 4X and which has the role of bearing coolant and lubricant. The axial thrust compensator consists of an axial gap 5, FIG. 4, which is defined by the surfaces 5X and 5Y, FIGS. 3A and 3B. The gap 5 is filled with the medium pressure liquid rich fluid 255 directed into the axial gap by a set of passages that penetrate the surface 5X which has the key role of axially separating the diffuser 8 and the impeller assembly 6. The the axial pressure produced between the surface 5X and 5Y is relatively independent of the axial dimensional variation of the gap 5. The excess medium pressure liquid rich fluid 7, FIG. 3B, flows alongside surface 5Y between the surfaces 4Y and 4X, in opposite axial direction of the primary multiphase flow 105 towards re-mixing, alongside with the radial lubrication fluid the path 255*b*, FIG. 3B, with the primary multiphase process fluid 105. The re-mixing is possible because the primary multiphase process fluid 105 is at a lower pressure than the medium pressure liquid rich fluid 255.

The multiphase process fluid subsystem includes a main or first G/LEU (gas liquid extraction unit) 102. In certain instances, as shown, the first G/LEU 102 is a tank separator, but other types of separators would work. FIG. 1A shows the extracted liquid 102*a* and the extracted gas 102*b*. Liquid line 103 is coupled to a liquid outlet of the first G/LEU 102 and carries process liquid towards the suction inlet of the pump 200 (discussed in more detail below). Gas line 104 is coupled to a gas outlet of the first G/LEU 102 and carries gas from the first G/LEU 102 with the pressure equal to the liquid line 103 (i.e., system low pressure). Gas line has a portion 104*a* extending to an input of an ejector 106. Ejector 106 boosts gas line 104*a* pressure to a system medium pressure. In certain instances, the ejector 106 is a venturi scrubber, but other configurations of ejector would work. A medium pressure gas rich purge fluid line 107 is coupled to an outlet of the ejector 106.

The pump 200 also includes an auxiliary or second G/LEU (gas liquid extraction unit) 201 in a stationary inner portion of the pump stages 202. In certain instances, the second G/LEU 201 is configured as a gravity separator having a tank that collects the fluids and allows them to separate based on their density. FIG. 1A shows the extracted liquid 201*a*, the extracted gas 201*b*, and, in certain instances when water is present in the liquid line 103 or at the outlet of the ejector 106, FIG. 1C and FIG. 1D, show water extracted 201*d*.

While the primary pump 200 discharges its output through discharge line 105 (at a system high pressure), a discharge line 105*a* provides a portion of the pump 200 discharge to the ejector. The discharged fluid in line 105*a* is rich with liquid, low GVF (Gas Volume Fraction), internally separated by an integrated separator 210 from the last stage of the pump 200, and provides the motive fluid for the ejector 106. In certain instances, the integrated separator 210 can be configured as a fluid offtake from the radially outward edge of the fluid traveling through the discharge of the pump, which is primarily liquid. A line 201*c* extends from the second G/LEU 201. A portion of the fluid in line 201*c* flows into a lubrication inlet 255*a* into the pump 200 to the bearings 211 to provide liquid rich lubrication to the bearings 211. In addition to lubrication, the fluid from line 255*a* provides the function of heat removal for the bearings 211 and merges with the lower pressure process fluid through the lines 255*b*. The remaining overflow fluid 201*c* from the second G/LEU 201 is directed to the suction side of the pump 200, for example, merging with the lower pressure liquid output from the first G/LEU 102 (e.g., at line 103). A gas line 205 extracts gas collected from the second G/LEU 201, which is at a system medium pressure. The gas line 205 splits into two portions 205*a* and 205*b*. Line 205*a* is gas rich at system medium pressure, and is feeding the motor's gap 204 and passing towards the low-pressure suction chamber for re-mixing with liquid output from the first G/LEU 102 (e.g., at line 103). Line 205*b* is overflow gas at system medium pressure.

An actuable control valve 108 is provided, normally closed on line 205*b* and normally open on line 104. The valve 108 is configured to change status if the gas 201*b* in the second G/LEU 201 exceeds a set threshold. Another actuable control valve 109 is normally closed on the overflow line 201*c*. The valve changes status if liquid 201*a* in the second G/LEU 201 exceeds a set volume. Additional check valves, check valve 110 and check valve 111, are provided in lines 205*b* and 201*c*, respectively to prevent backflow toward the second G/LEU 201.

Figure 1B:
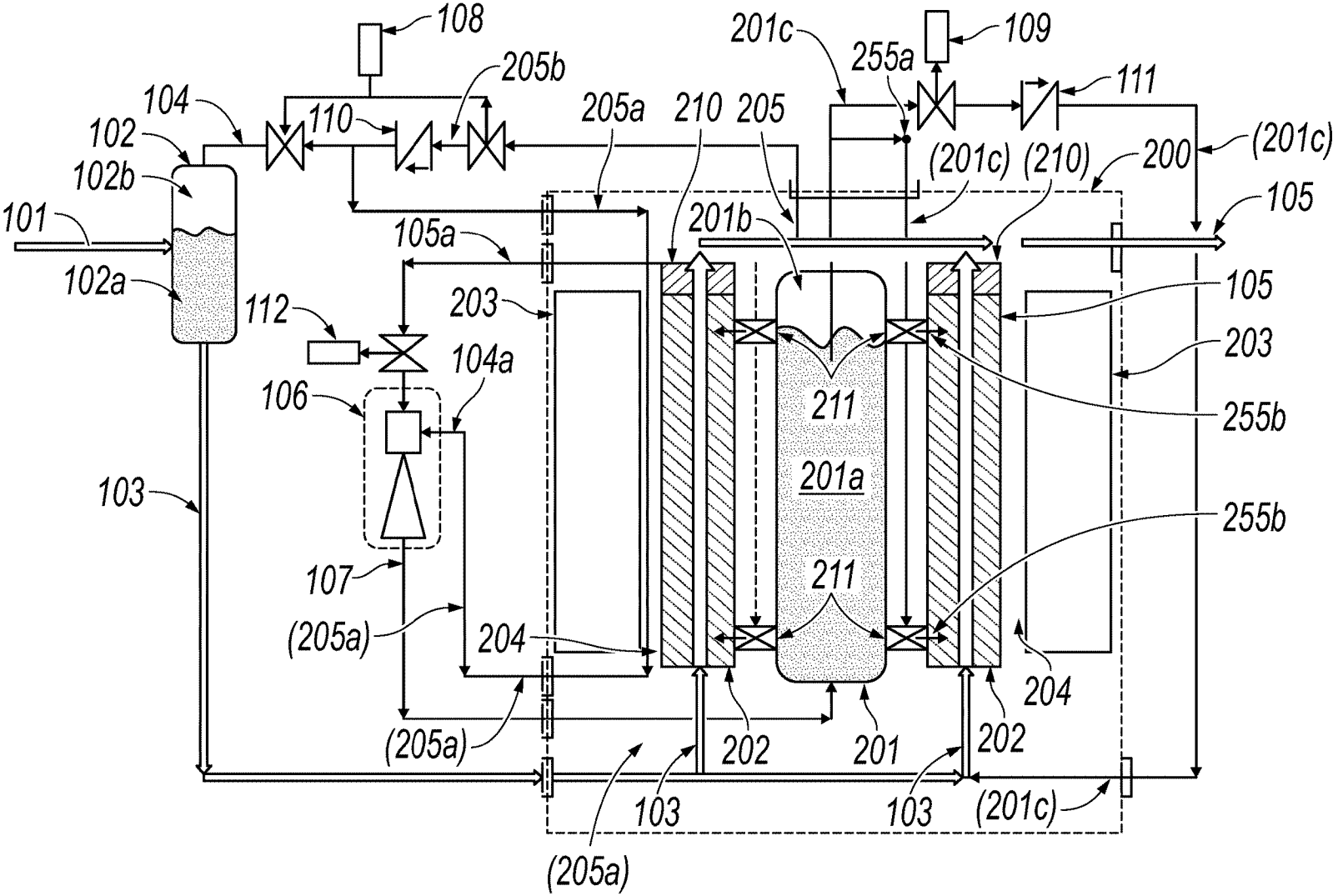
Figure 1C:
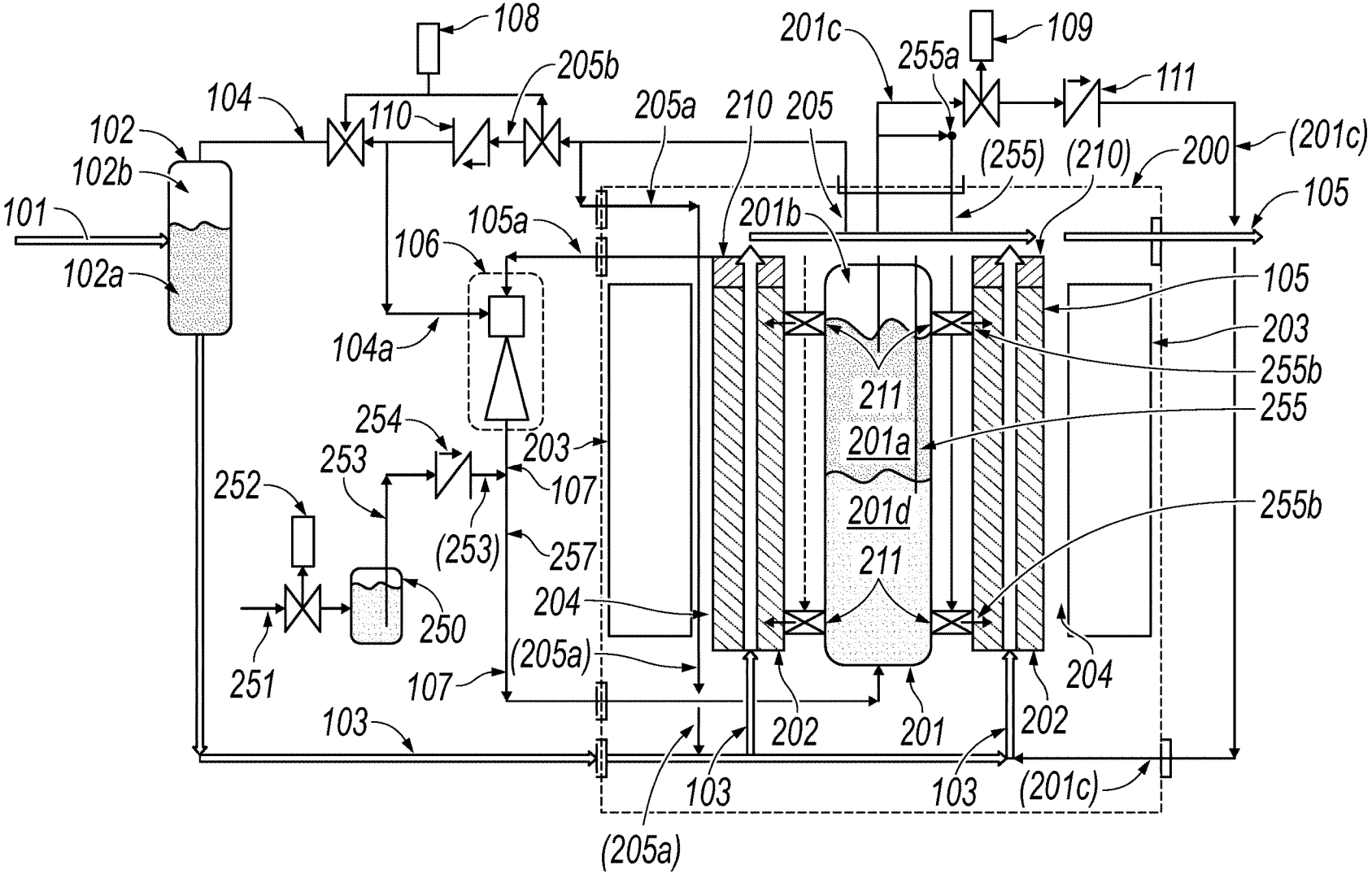
Figure 1D:
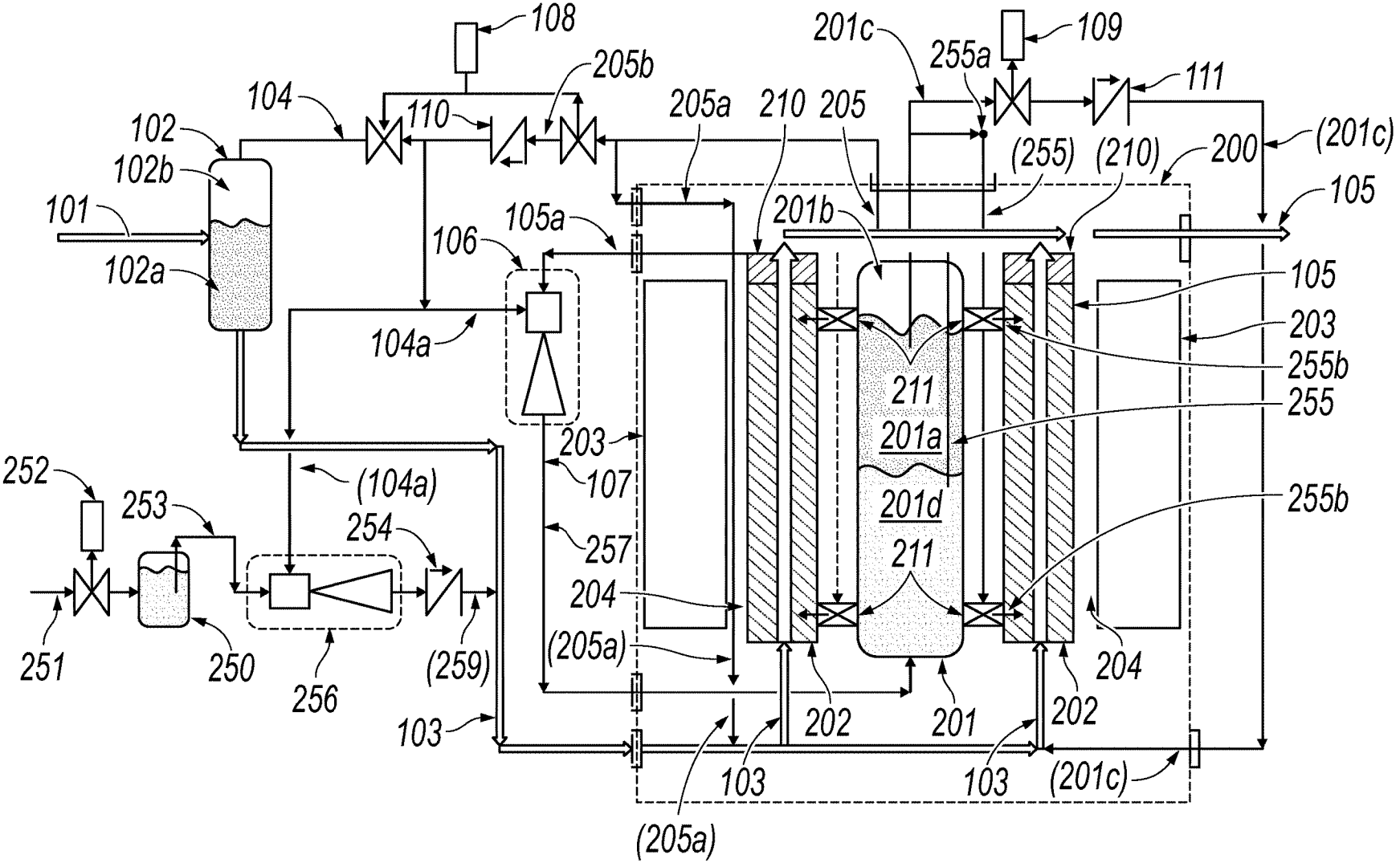

The configuration of FIG. 1B is the same as FIG. 1A, but additionally includes an actuable valve 112 on line 105*a* that, when adjusted, controls the flow and pressure from the outlet of the ejector 106, i.e., line 107.

The configurations of FIG. 1C and FIG. 1D are the same as FIG. 1A, but additionally include a water injection system based on a water tank 250 that can store a water supply at ambient pressure or at medium pressure as defined above. An actuable valve 252 controls the water flow and provides water supply from the line 251. FIG. 1C shows overflow line 253 feeding water into the line 107. Line 107 extends from the outlet of the ejector 106 and, the mixed fluids in line 257 feed into the second G/LEU 201. The second G/LEU 201 separates the water 201*d*, which in turn, is collected from the second G/LEU 201 by the line 255 that is connected to the lubrication line intake 255*a*. The water based liquid injection in the pumped fluid 105 results in the discharged fluid in line 105*a* being rich with water based liquid, low GVF (Gas Volume Fraction). As in the examples from FIG. 1A and FIG. 1B, the fluid 105 is internally separated by an integrated separator 210 at the last stage of the pump 200, and provides the motive fluid for the ejector 106. The water volume addition to this re-circulation process is ensured by the water reservoir and the actuable control valve 252.

The configuration of FIG. 1D is the same as FIG. 1C, but the overflow line 253 feeds water into the line 103. The second G/LEU 201, separates the water 201*c* that is, in turn, collected by the line 255 that is connected to the lubrication line intake 255*a*. The water based liquid injection in the pumped fluid 105 results in having the discharged fluid in line 105*a* rich with water based liquid, low GVF (Gas Volume Fraction). As in the example from FIG. 1C, the fluid 105 is internally separated by an integrated separator 210 from the last stage of the pump 200, and provides the motive fluid for the ejector 106. As in FIG. 1C, the water volume addition to this re-circulation process is ensured by the water reservoir and the actuable control valve 252.

Before start up, the motor gap 204 and pump stages 202 are filled with process fluid from line 103 at system low pressure. The second G/LEU 201 is filled with gas from line 104 since lines 107 or 257, in the absence of a highly pressurized motive fluid via line 105*a*, are mostly gas from line 104 at system low pressure.

During start up the pump section gradually, with speed increase, elevates the pressure at its discharge stages 105 and 105*a*. As motive of the ejector 106, the liquid from line 105*a* activates the ejector's operation and gradually elevates the pressure of line 107 or 257 above line 103 and line 104. The pressure in the second G/LEU 201, elevates and the gas represented by the line 205*a* purges the gap 204.

During steady state operation (after the transient start-up), the separation of a significantly liquid rich, low GVF (Gas Volume Fraction) fluid in line 105*a*, provided by the integrated separator 210 located at the final stage of the pump, is used as motive for the ejector 106 and results in a medium system pressure gas rich fluid, high GVF fluid in line 107 or 257 which is separated in liquids and gas inside the second G/LEU 201. The medium system pressure gas collected from second G/LEU 201 is continuously injected in the motor gap 204 and, having a higher pressure than the process fluid in the suction area (line 103) ensures a one-way flow from the gap towards the suction chamber. The mass flow of line 205*a* is designed to ensure the heat removal generated by drag losses and electromagnetic components during the pump operation. The mass flow of the line 255*a* is designed to ensure substantial heat removal of the heat generated by the bearings.

If the liquids in the second G/LEU 201 exceed a maximum level set to prevent liquid contamination of the gas line 205*a*, an overflow valve purges the excess fluid, which is at system medium pressure, into the process fluid line which is at system low pressure. In certain operational conditions, the gas in line of the ejector 106, normally fed by the low pressure line from the first G/LEU 102, may be switched to the line 205*b* of the medium pressure second G/LEU 201.

Accordingly, the concepts herein encompass a fluid system for managing a multiphase fluid. The fluid system includes a fluid subsystem having a suction, a discharge and a motor. A liquid separator resides at the discharge of the fluid subsystem. A first gas/liquid extraction unit of the system has a multiphase fluid inlet and a liquid outlet. The liquid outlet is coupled to the suction for providing a primary liquid rich fluid to the suction. An ejector is coupled to a gas outlet of the first gas/liquid extraction unit to receive a secondary gas rich fluid and coupled to a liquid outlet of the liquid separator to receive a liquid rich fluid from the liquid separator. A second gas/liquid extraction unit of the system has an inlet coupled to an outlet of the ejector. The second gas/liquid extraction unit has a liquid rich fluid outlet coupled to an internal bearing lubrication inlet of the fluid subsystem.

The concepts herein encompass a method of managing a multiphase fluid. In the method a first liquid rich fluid flow and a gas rich fluid flow are extracted from a multiphase fluid flow.

The first liquid rich fluid flow is received at a suction of a fluid subsystem and drives the first liquid rich fluid flow to a discharge of the fluid subsystem. A second liquid rich fluid flow is separated from the discharge of the fluid subsystem. A third liquid rich fluid flow is extracted from the gas rich fluid flow and the second liquid rich flow and lubricating bearings of the fluid subsystem with the third liquid rich fluid flow.

The concepts herein encompass a system include a pump with bearings. A first gas/liquid extraction unit has a liquid outlet coupled to a suction of the pump. A second gas/liquid extraction unit has an inlet coupled to a gas outlet of the first gas/liquid extraction unit and a liquid outlet coupled to supply liquid rich fluid to the bearings.

The concepts above can encompass some, none or all of the following aspects. For example, the fluid subsystem can include a subsea pump subsystem configured to operate submersed in a body of water. The fluid subsystem can include a top side-less inside out pump. In certain instances, the ejector is powered to pump fluid to its outlet by fluid from the discharge of the fluid subsystem. In certain instances, the fluid subsystem is configured to operate in a vertical orientation. The second gas/liquid extraction unit can be within the fluid subsystem. In certain instances, the second gas/liquid extraction unit includes a gravity separator.

In certain instances, the fluid subsystem includes a passage for bearing lubrication internally integrated in stationary hydraulic components of the fluid subsystem. The passage for bearing lubrication can supply the liquid rich fluid to pump stages of the fluid subsystem to re-mix with fluid passing from the suction to the discharge of the fluid subsystem. In certain instances, the fluid subsystem can include a plurality of axially arranged stage modules with a plurality of axial gaps into which a portion of the liquid rich fluid from the second gas/liquid extraction unit is supplied at a pressure to axially support the gaps. Hydraulic passages can be integrated between the stationary and revolving hydraulic components of the fluid subsystem for the portion of the secondary liquid rich fluid that exercises axial pressure to re-mix in the journal bearings gap with the portion of the secondary liquid rich fluid used as bearing lubrication fluid. In certain instances, a water source coupled to at least one of the suction or the inlet of the second gas/liquid extraction unit. The water based bearing lubrication and cooling fluid is recirculated and, in certain instances, an external water supply provides only for the leaks of the closed loop water based fluid flow circuit. The water supply can include a pressurized storage vessel with the pressure higher than the pressure at the suction of the fluid subsystem. In certain instances, water from a source apart from the source of the multiphase fluid is supplied to the suction of the fluid subsystem or to a gas/liquid extraction unit that operates in extracting the third liquid rich fluid flow from the gas rich fluid flow and the second liquid rich fluid flow. In certain instances, the gas rich fluid and the second liquid rich fluid are driven to a gas/liquid extraction unit with an ejector driven by the second liquid rich fluid. Extracting the third liquid rich fluid flow from the gas rich fluid flow and the second liquid rich fluid flow can include extracting the third liquid rich fluid flow with the gas/liquid extraction unit.

A number of embodiments have been described. Nevertheless, it will be understood that various modifications may be made. Accordingly, other embodiments are within the scope of the following claims.

What is claimed is:

1. A fluid system for managing a multiphase fluid, comprising:

a fluid subsystem having a suction, a discharge and a motor;

a liquid separator at the discharge of the fluid subsystem;

a first gas/liquid extraction unit having a multiphase fluid inlet and a liquid outlet, the liquid outlet coupled to the suction for providing a first liquid rich fluid to the suction;

an ejector coupled to a gas outlet of the first gas/liquid extraction unit to receive a secondary gas rich fluid and coupled to a liquid outlet of the liquid separator to receive a second liquid rich fluid from the liquid separator; and a second gas/liquid extraction unit having an inlet coupled to an outlet of the ejector, the second gas/liquid extraction unit having a liquid rich fluid outlet coupled to an internal bearing lubrication inlet of the fluid subsystem.

2. The fluid system of claim 1, where the fluid subsystem comprises a subsea pump subsystem configured to operate submersed in a body of water.

3. The fluid system of claim 1, where the fluid subsystem comprises a top side-less inside out pump.

4. The fluid system of claim 1, where the ejector is powered to pump fluid to the outlet by fluid from the discharge of the fluid subsystem.

5. The fluid system of claim 1, where the fluid subsystem is configured to operate in a vertical orientation.

6. The fluid system of claim 1, where the second gas/liquid extraction unit is within the fluid subsystem.

7. The fluid system of claim 5, where the second gas/liquid extraction unit comprises a gravity separator.

8. The fluid system of claim 1, where the fluid subsystem comprises a passage for bearing lubrication internally integrated in stationary hydraulic components of the fluid subsystem.

9. The fluid system of claim 8, where the passage for bearing lubrication supplies the liquid rich fluid to pump stages of the fluid subsystem to re-mix with fluid passing from the suction to the discharge of the fluid subsystem.

10. The fluid system of claim 1, where the fluid subsystem comprises a plurality of axially arranged stage modules comprising a plurality of axial gaps into which a portion of the liquid rich fluid from the second gas/liquid extraction unit is supplied at a pressure to axially support the gaps.

11. The fluid system of claim 4, where hydraulic passages are integrated between stationary and revolving hydraulic components of the fluid subsystem for the portion of the second liquid rich fluid that exercises axial pressure to re-mix in a journal bearings gap of the fluid subsystem with the portion of the second liquid rich fluid used as bearing lubrication fluid.

12. The fluid system of claim 1, comprising a water source coupled to at least one of the suction or the inlet of the second gas/liquid extraction unit.

13. The fluid system of claim 12, where the water source comprises a pressurized storage vessel with the pressure higher than the pressure at the suction of the fluid subsystem.

14. A method of managing a multiphase fluid, comprising:

using a fluid system in accordance with claim 1 to perform operations comprising:

extracting a first liquid rich fluid flow and a gas rich fluid flow from a multiphase fluid flow;

receiving the first liquid rich fluid flow at a suction of a fluid subsystem of the fluid system and driving the first liquid rich fluid flow to a discharge of the fluid subsystem of the fluid system;

separating a second liquid rich fluid flow from the discharge of the fluid subsystem; and extracting, by a gas/liquid extractor of the fluid system, a third liquid rich fluid flow from the gas rich fluid flow and the second liquid rich fluid flow and lubricating bearings of the fluid subsystem with the third liquid rich fluid flow.

15. The method of claim 14, where the fluid subsystem comprises a subsea pump subsystem configured to operate submersed in a body of water.

16. The method of claim 14, comprising supplying water from a source apart from the source of the multiphase fluid to the suction of the fluid subsystem or to the gas/liquid extractor of the fluid system that operates in extracting the third liquid rich fluid flow from the gas rich fluid flow and the second liquid rich fluid flow.

17. A method of managing a multiphase fluid, comprising:

extracting a first liquid rich fluid flow and a gas rich fluid flow from a multiphase fluid flow;

receiving the first liquid rich fluid flow at a suction of a fluid subsystem and driving the first liquid rich fluid flow to a discharge of the fluid subsystem;

separating a second liquid rich fluid flow from the discharge of the fluid subsystem;

extracting a third liquid rich fluid flow from the gas rich fluid flow and the second liquid rich flow and lubricating bearings of the fluid subsystem with the third liquid rich fluid flow;

driving the gas rich fluid flow and the second liquid rich fluid flow to a gas/liquid extraction unit with an ejector driven by the second liquid rich fluid flow; and where extracting the third liquid rich fluid flow from the gas rich fluid flow and the second liquid rich fluid flow comprising extracting the third liquid rich fluid flow with the gas/liquid extraction unit.

18. A system comprising:

a pump comprising bearings;

a first gas/liquid extraction unit comprising a liquid outlet coupled to a suction of the pump;

an ejector coupled to a gas outlet of the first gas/liquid extraction unit to receive a gas rich fluid and coupled to a discharge of the pump to receive a second liquid rich fluid; and a second gas/liquid extraction unit comprising an inlet coupled to an outlet of the ejector and comprising a liquid outlet coupled to supply liquid rich fluid to the bearings.

19. The system of claim 18, where the pump comprises a subsea pump configured to operate submersed in a body of water.

* * * * *